United States Patent [19]

Parslow, Jr. et al.

[11] Patent Number: 4,893,642

[45] Date of Patent: Jan. 16, 1990

[54] PRODUCTION LINE PART DEBURRING APPARATUS

[75] Inventors: Harold W. Parslow, Jr.; Timothy M. Parslow, both of Mt. Clemens, Mich.

[73] Assignee: GraPar Corporation, Warren, Mich.

[21] Appl. No.: 296,189

[22] Filed: Jan. 11, 1989

[51] Int. Cl.[4] ..... B08B 3/02

[52] U.S. Cl. ..... 134/66; 134/82; 134/144; 134/153; 134/172

[58] Field of Search ..... 134/66, 68, 72, 82, 134/133, 144, 148, 149, 153, 157, 159, 172; 34/8, 58

[56] References Cited

U.S. PATENT DOCUMENTS

| | | | |
|---|---|---|---|
| Re. 31,593 | 6/1984 | Judge, Jr. . | |
| 2,181,503 | 11/1939 | Biggert . | |
| 2,483,477 | 10/1949 | Shorter . | |
| 2,580,344 | 12/1951 | Clayborne . | |
| 2,596,345 | 5/1952 | Penrod . | |
| 2,616,549 | 11/1952 | Ornitz . | |
| 2,726,642 | 12/1955 | Zinty et al. . | |
| 2,824,029 | 2/1958 | Zinty . | |
| 2,857,923 | 10/1958 | Zinty . | |
| 2,972,995 | 2/1961 | Umbright et al. . | |
| 3,022,790 | 2/1962 | Carrie . | |
| 3,047436 | 7/1962 | Zinty . | |
| 3,052,245 | 9/1962 | Nagle . | |
| 3,060,064 | 10/1962 | Zingg . | |
| 3,074,417 | 1/1963 | Lisowski et al. . | |
| 3,083,716 | 4/1963 | Rowan et al. . | |
| 3,166,082 | 1/1965 | Arnold et al. . | |
| 3,225,777 | 12/1965 | Shelton et al. . | |
| 3,267,551 | 8/1966 | Judge . | |
| 3,416,545 | 12/1968 | Holzemer . | |
| 3,474,650 | 10/1969 | Judge et al. . | |
| 3,578,002 | 5/1971 | Rowan et al. . | |
| 3,608,568 | 9/1971 | Hallsworth . | |
| 3,615,824 | 10/1971 | Hittel et al. . | |
| 3,633,594 | 1/1972 | Boundy . | |
| 3,699,983 | 10/1972 | Morley . | |
| 3,703,905 | 11/1972 | Ice, Jr. . | |
| 3,979,220 | 9/1976 | Ishiyama et al. . | |
| 4,090,907 | 5/1978 | Anderson . | |
| 4,144,730 | 3/1979 | Judge, Jr. . | |
| 4,178,652 | 12/1979 | Adams et al. | 134/144 X |
| 4,240,453 | 12/1980 | Vial et al. . | |
| 4,290,238 | 9/1981 | Judge, Jr. . | |
| 4,365,383 | 12/1982 | Bartlett | 134/148 X |
| 4,416,130 | 11/1983 | Judge, Jr. . | |
| 4,424,082 | 1/1984 | Rowan . | |
| 4,425,776 | 1/1984 | Judge, Jr. . | |
| 4,432,629 | 2/1984 | Caflisch . | |
| 4,682,444 | 7/1987 | Judge et al. . | |

FOREIGN PATENT DOCUMENTS

| | | |
|---|---|---|
| 1446456 | 6/1966 | France . |

*Primary Examiner*—Philip R. Coe
*Assistant Examiner*—Stephen F. Gerrity
*Attorney, Agent, or Firm*—Basile and Hanlon

[57] ABSTRACT

Apparatus for cleaning/deburring manufactured parts, each part having an established axis of rotation, includes a conveyor operable to convey the parts in succession in intermittent step-by-step movement to a cleaning-/deburring station and a drying station. At each of the cleaning/deburring and drying stations the part is driven in high speed rotation about its axis by a part rotating device. At the cleaning/deburring station the rotating part is sprayed with high pressure fluid and at the drying station high velocity air is discharged tangentially against the rotating part to strip residual fluid from the part. The spray nozzle assembly can be stationary, or can take the form of a transversing assembly for reciprocating movement along the longitudinal length of the part. Additionally, the transversing assembly can include rotation of the nozzle assembly about an axis as the nozzles are reciprocated longitudinally. Alternatively, the spray nozzle assembly can take the form of a pantograph assembly allowing the spray nozzles to trace the contours of the surface of the part as it rotates at high speed.

16 Claims, 4 Drawing Sheets

PRODUCTION LINE PART DEBURRING APPARATUS

RELATED APPLICATIONS

This application is a continuation-in-part of copending U.S. application Ser. No. 07/065,280 filed on Jun. 22, 1987 entitled "Production Line Part Cleaning Apparatus."

BACKGROUND OF THE INVENTION

The present invention is directed to an apparatus employed to clean, deburr, and dry manufactured metal parts on a production line basis and is especially concerned with deburring of parts such as engine crank shafts, cam shafts, vehicle axles, etc. which have an established axis of rotation.

Prior art approaches to cleaning of manufactured metal parts typically involve either the conveying of the parts through a spray booth past a battery of nozzles which spray cleaning fluid onto the parts or by immersing the parts in a tank of cleaning solution. In some cases, to increase the volume of parts passing through the cleaning system, tote boxes filled with parts are conveyed through a booth in which the tote boxes are flooded or overfilled with cleaning solution or the entire tote box is immersed in a tank of cleaning solution in which either or both of the bath and tote box are agitated.

In general the prior art approaches all require large volumes of cleaning fluid and require a difficult compromise between thoroughness of cleaning (all surfaces equally) and production output rate. Systems which employ tote boxes filled with loose parts obviously are not acceptable for cleaning parts having machined surfaces, particularly if the tote box is to be flooded with cleaning fluid and then tilted or inverted to drain the box or if the box is to be agitated in a bath of cleaning fluid.

The present invention is especially directed to a part cleaning, deburring, and drying system in which manufactured parts having an established axis of rotation, such as engine crank shafts, for example, may be thoroughly cleaned, deburred and dried individually on a production line basis.

SUMMARY OF THE INVENTION

In accordance with the present invention, like parts, each having an established axis of rotation, are conveyed in succession in intermittent step-by-step movement by a conveyor to a cleaning/deburring station and then to a drying station located downstream of the conveyor from the cleaning/deburring station.

In the present invention, at the cleaning/deburring station and at the drying station, similar part rotating devices are mounted. Each part rotating device consists of a pair of opposed spindles mounted for rotation about a fixed horizontal axis which is normal to the conveying path and so located as to be coaxially aligned with the axis of rotation of a part mounted on the conveyor carrier when the carrier is at the end of its forward stroke. The spindles are mounted for coordinated movement toward and away from each other and are normally retracted from each other to permit a part to be moved between the two spindles by the conveyor. When the part is axially aligned between the two spindles, the conveyor is temporarily held stationary and the spindles are moved toward each other to seat against opposite ends of the part. The part is then discharged from the conveyor, leaving the part coaxially gripped between the two spindles. While the part is so gripped, one of the spindles is driven in high speed rotation preferably in a range from 100–1100 rpm to centrifugally spin off fluid from the part.

At the cleaning/deburring station, a set of spray nozzles are located to discharge fluid in high pressure jets preferably in the range of 3,000 to 12,000 psi which are directed at predetermined areas of the part as the part is being driven in high speed rotation, preferably in the range of 100–500 rpm to centrifugally spin off fluid from the part. In one embodiment, pantograph nozzle means for following the contour of the part as it rotates, maintains each nozzle in precision close proximity to the surface of the part as the part rotates. Another embodiment provides transversing nozzle means to reduce fluid flow requirements thereby reducing floor space requirements, downsizing pumps, reducing operating costs etc.. In yet another embodiment, the transversing nozzle means includes nozzle rotation means.

At the drying station, the part is driven in high speed rotation preferably in the range of 500 to 1000 rpm to centrifugally spin fluid off the part while a high velocity stream of air preferably in the range of 100–200 mph is discharged from an elongate slot-like nozzle opening having a length commensurate with the length of the part in a path tangential to the rotating part at a location where the rotating part is moving in a direction opposite to that of the air stream.

At the start of the next cycle of movement of the conveyor, the carrier on its elevating stroke moves upwardly into engagement with the spindle supported parts at the cleaning and drying stations and the spindles of the rotating devices are retracted.

By employing high pressure fluid and high velocity drying air and by rapidly rotating the parts while they are being sprayed and dried, the parts may be handled individually and thoroughly cleaned/deburred and dried in a relatively short cycle time.

Other objects and features of the invention will become apparent by reference to the following specification and to the drawings.

DESCRIPTION OF THE PREFERRED EMBODIMENTS

Figure 1:
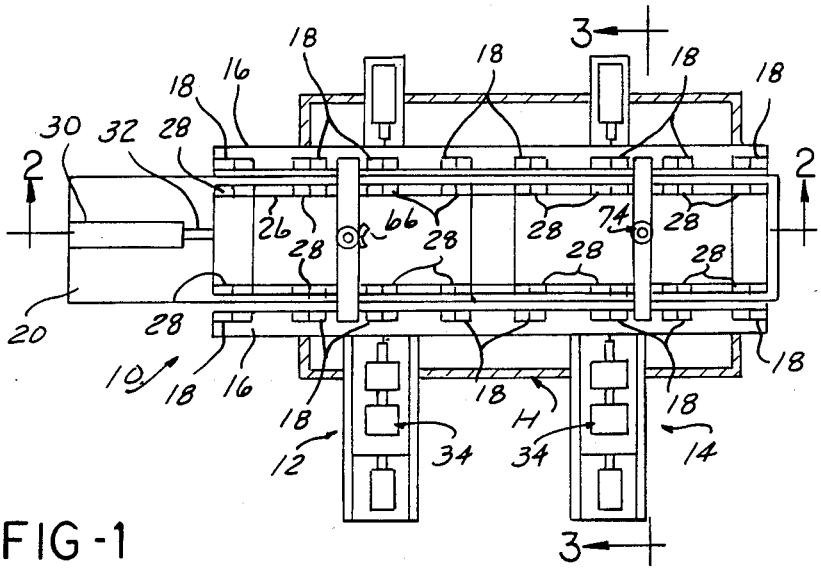
FIG. 1 is a schematic top plan view of one form of apparatus embodying the present invention with certain parts omitted or shown in section.
Figure 2:
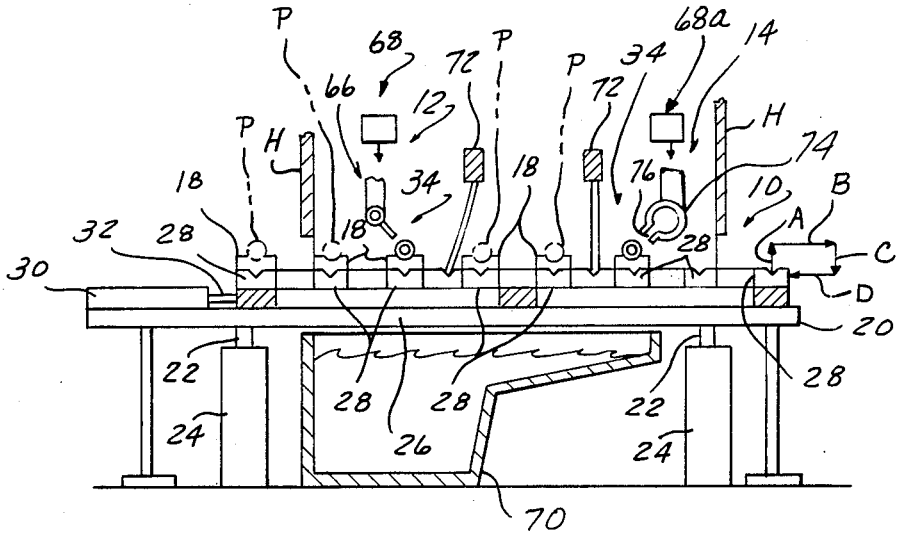
FIG. 2 is a schematic cross-sectional view of the apparatus of FIG. 1, with certain parts omitted, added, broken away and shown in section.

An exemplary form of parts cleaning/deburring apparatus embodying the present invention includes, as best seen in FIGS. 1 and 2, a conveyor designated generally 10 which is adapted to convey like manufactured parts, each having an established axis of rotation, in step-by-step movement along a path in which the parts are advanced in succession to a cleaning/deburring station designated generally 12 and then to a drying station designated generally 14.

Conveyor 10 has been illustrated schematically because it may take any of several forms of conveyors of the general type referred to as walking beam conveyors or lift and carry conveyors. Such a conveyor typically includes a pair of spaced parallel fixed side frame members 16 which extend along opposite sides of the conveyor and fixedly support a plurality of uniformly spaced cradle blocks 18. As best seen in FIG. 2, the cradle blocks 18 may be formed with a V-shaped notch in their upper surface which is adapted to receive and locate the end of a shaft-like part P. The two aligned cradle blocks 18 at opposite sides of conveyor 10 will support the part with the rotative axis of the part extending transversely across the conveyor in a direction perpendicular to the path of movement of parts along the conveyor. The particular parts P may, for example, be engine crank shafts, cam shafts, or other shaft type parts formed with coaxial shaft-like portions at opposite ends which define the established axis of rotation of the part.

The conveying portion of conveyor 10 which is operable to move the parts in step-by-step movement from one pair of stationary cradle blocks 18 to the next may include a lift platform designated generally 20 which extends horizontally and may be supported upon the piston rods 22 (FIG. 2) of a pair of vertically disposed lift cylinders 24. A carrier frame 26 is slidably mounted upon the top of platform 20 for horizontal reciprocation between side frame members 16. Carrier frame 26 carries along each of its opposite sides uniformly spaced sets of cradle blocks 28 of a construction and spacing the same as the stationary cradle blocks 18. A reciprocatory drive cylinder 30 is fixedly mounted upon platform 20 and its piston rod 32 is connected to carrier frame 26 to drive carrier frame 26 in horizontal reciprocatory movement.

In FIGS. 1 and 2, platform 20 and carrier frame 26 are shown in their normally maintained start position in which the piston rods 22 of cylinders 24 are in their retracted position to locate platform 20 at its lowermost end limit of movement and piston rod 32 of drive cylinder 30 is likewise in its retracted position, establishing carrier frame 28 at its extreme left-hand end limit of movement as shown in FIGS. 1 and 2.

In operation, cylinders 24 and 30 are driven in a coordinated cycle. The first step of this cycle finds lift cylinders 24 being actuated to extend their piston rods 22 and lift platform 20 upwardly from the position shown in FIG. 2. This upward movement of platform 20 carries with it carrier frame 26, and as the platform rises the cradle blocks 28 on carrier frame 26 move upwardly into engagement with the parts P supported upon stationary cradles 18 and lift the parts upwardly clear of cradles 18 when the platform reaches its fully elevated position. This upward movement of platform 20 is indicated by the arrow A at the right-hand end of FIG. 2.

Platform 20 is held in this elevated position and drive cylinder 30 is then actuated to extend its piston rod 32 to drive carrier frame 26 to the right as viewed in FIG. 2 to carry the parts P supported upon carrier frame 20 forwardly a distance equal to the spacing between adjacent carrier blocks 18. This movement is indicated by the arrow B at the right-hand end of FIG. 2. This movement of carrier frame 26 carries each part forwardly (to the right as viewed in FIGS. 1 and 2) from vertical alignment with one set of cradle blocks 18 into vertical alignment with the next adjacent set of cradle blocks 18.

The next step in the conveying cycle finds lift cylinders 24 actuated to lower platform 20 back to its original elevation, as indicated by the arrow C in FIG. 2. During this lowering movement, support of the parts is transferred back to the stationary cradle blocks 18 and platform 20 is lowered until its cradle blocks 28 are vertically clear of the parts.

The next and final step in the cycle finds drive cylinder 30 actuated to retract its piston rod to return carrier frame 26 to its original start position, this movement being indicated by the arrow D in FIG. 2.

A part rotating device designated generally 34 is located at each cleaning/deburring station 12 and drying station 14. Both of the part rotating devices 34 are of similar construction, this construction being best illustrated in FIG. 3.

Figure 3:
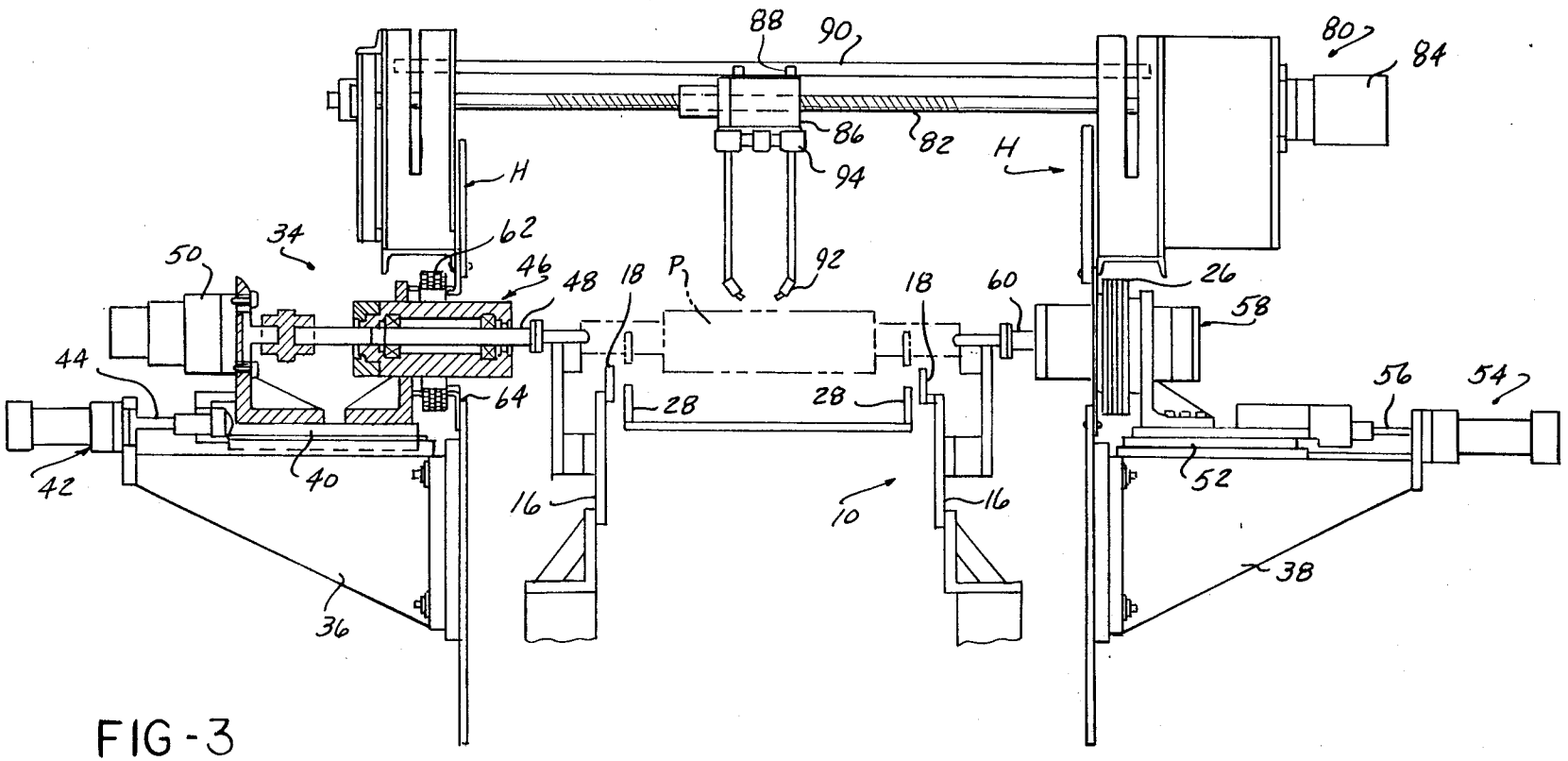
FIG. 3 is a cross-sectional view taken on line 3—3 of FIG. 1, with certain parts omitted, added, broken away or shown in section.

Referring now to FIG. 3, each part rotating device 34 includes a first stationary platform 36 and a second stationary platform 38, the platforms 36 and 38 being fixedly mounted in transverse alignment with each other at opposite sides of conveyor 10. A carrier plate 40 is slidably mounted upon the top surface of platform 36 for horizontal movement toward and away from the conveyor center line and a reciprocating piston motor designated generally 42 has its cylinder fixedly mounted upon platform 40 and its piston rod 44 coupled to carrier plate 40 to drive the carrier plate in movement from left to right and vice versa as viewed in FIG. 3, plate 40 being shown at its right-hand end limit of movement as viewed in FIG. 3.

At the end of carrier plate 40 adjacent conveyor 10, a bearing sleeve designated generally 46 rotatively supports a spindle 48 for rotation about a horizontal axis normal to the direction of movement of the parts along conveyor 10, which is toward the observer as viewed in FIG. 3. Carrier plate 40 also carries a rotary drive motor 50 coupled to spindle 48 and operable to drive spindle 48 in rotation about its axis.

The opposite platform 38 of part rotating device 34 likewise supports a carrier plate 52 for horizontal sliding movement toward and away from the center line of conveyor 10, a reciprocating piston motor 54 having its cylinder fixedly mounted on platform 38 and its piston rod 56 coupled to carrier plate 52 to reciprocate the plate in horizontal movement from right to left and vice versa as viewed in FIG. 3. Carrier plate 52 is at its left-hand end limit of movement as viewed in FIG. 3.

Like carrier plate 40, carrier plate 52 carries a bearing sleeve designated generally 58 of a construction similar to bearing sleeve 46, a second spindle 60 being supported in sleeve 58 for free rotation about a horizontal axis which is coaxially aligned with the axis of rotation of the driven spindle 48 at the opposite side of the conveyor.

The carrier plates 40 and 52 are normally disposed in a retracted position in which the piston rods 44 and 56 of motors 42 and 54 are retracted further into their respective cylinders than is illustrated in FIG. 3. When so retracted, the ends of the respective spindles 48 and 60 are axially spaced from each other by a distance greater than the axial length of parts P which are to be cleaned, deburred and dried. When the carrier plates are in their extended position shown in FIG. 3, a part P is coaxially engaged at its opposite ends by the spindles 48 and 60 and supported clear of cradles 18 of the conveyor. The part P so engaged by the spindles may thus be driven in rotation about its axis by operation of motor 50.

When the platforms 40 and 52 are located in their retracted positions, the parts P may be moved into and from positions between the retracted spindles 48 and 60.

The aligned axes of spindles 48 and 60 are so located relative to the conveyor that, referring to FIG. 2, when the conveyor reaches the right-hand end of stroke B of its cycle, the rotational axis of part P is coaxially aligned with the retracted spindles. Motors 42 and 54 are actuated to drive spindles 48 and 60 inwardly to engage the aligned part P after the completion of stroke B of the conveyor and before the commencement of stroke C.

Because the cleaning/deburring and drying operations are preferably performed within a housing designated generally H, a bellows like seal 62 may be connected between the housing and bearing sleeves 46 to seal the opening, such as 64 in the housing through which the bearing sleeve is reciprocated.

Returning now to FIGS. 1 and 2, at cleaning/deburring station 12, a nozzle manifold 66 is mounted at a location such that jets of high pressure fluid may be discharged from the manifold 66 against a part P held by the part rotating device 34 located at the cleaning-/deburring station. Manifold 66 is supplied with fluid under pressure preferably in the range of 40 to 12,000 psi from a valve controlled pressurized source of fluid schematically illustrated at 68. The configuration of manifold 66 and the location and orientation of various discharge nozzles on the manifold will be conformed to the configuration of the part P being cleaned and/or deburred to provide a thorough exposure of the part to the jets of pressurized fluid discharged from manifold 66. The part will be driven in high speed rotation preferably in the range of 50 to 1,100 rpm while being sprayed so that a thorough exposure of the part to the fluid is achieved. A collection tank 70 (FIG. 2) is located below the cleaning/deburring station to collect fluid. Fluid collected in tank 70 may be filtered and recycled to the fluid source 68. Preferably, one or more curtains such as 72 may be mounted within housing 10 to isolate cleaning/deburring station 12 from drying station 14.

For purposes of cleaning only, it has been found that relatively low fluid pressures can be used, i.e., fluid pressurized to 50 psi, flowing at a flow rate of approximately 60–200 gpm through a stationary manifold and stationary nozzles directed to impinge on a part rotating at 100 rpm has been found to be sufficient to remove contaminants, such as sealants used to inhibit rust and corrosion on metal parts during storage, oil, metallic chips and dirt, etc. from the surface of the part. However, it has been found that these low pressure cleaning systems are inadequate to remove microburrs and flashings found on machined surfaces, such as crank shafts and cam shafts. These microburrs and flashings are found adjacent the oil apertures passing through the main journals and pin journals of the crank shafts, and adjacent the undercut area of the polished journal surface, as well as on the polished surface itself. Cam shafts have microburrs and flashings adjacent the outer edges on each side of the polished metal lobes. In order to remove these microburrs and flashings, it has been found that increased pressure, preferably in the range of 3,000 to 8,000 psi of the fluid is required.

To achieve the desired fluid pressure, a charging pump delivers low pressure fluid at approximately 60 psi from a chilled fluid reservoir, which maintains the fluid at a temperature below 130° F. A portion of this fluid is passed through a filtration apparatus removing particles down to a 10 micron size. The filtered fluid stream is then delivered to the high pressure pump to provide pressurized fluid in the range of 3,000 to 8,000 psi. Due to the increased initial cost and operating cost of high pressure pumps, it is desirable to reduce the amount of flow required for the deburr process, while maintaining satisfactory removal of the microburrs and flashings. In order to accomplish this end, the stationary nozzles shown in FIGS. 1 and 2 have been modified in the upper portion of FIG. 3. The upper portion of FIG. 3 depicts transversing means 80 for reciprocating nozzles 92 along the longitudinal axis of part P. The transversing means 80 can include a worm gear 82 driven by a reversible motor 84. The worm gear 82 engages with an upper housing 86 to drive the nozzle assembly reciprocally along the longitudinal axis of the part P, while the part P is supported by the part rotating device 34 at cleaning/deburring station 12 and rotated at high speed. The housing 86 includes tabs 88 slidably engaged within guide means 90 to maintain the nozzle assembly in a vertical orientation as shown in FIG. 3 while it is driven between the two end limits of travel. Appropriate controls and signal switches (not shown) are engaged and operate at each end limit of travel to control the reversible motor 84 and the reciprocation of the nozzle assembly. The transversing means 80 can be used for cleaning and/or deburring various configurations of parts P being handled. The transversing nozzle means 80 has been advantageously employed in deburring cam shafts, wherein the cam shafts are rotated in the range of 80 to 1,100 rpm and fluid is pressurized in the range of 3,000 to 12,000 psi.

If required, depending upon the configuration of the particular part P being handled, the lower portion 94 of the housing 86 can be modified for rotation about the vertical axis. The combination of transversing movement and rotation of the part can increase overall part coverage by changing the angle of impingement of the pressurized fluid on the machined surfaces of the part P while maintaining the benefits of reduced flow rates.

Figure 4:
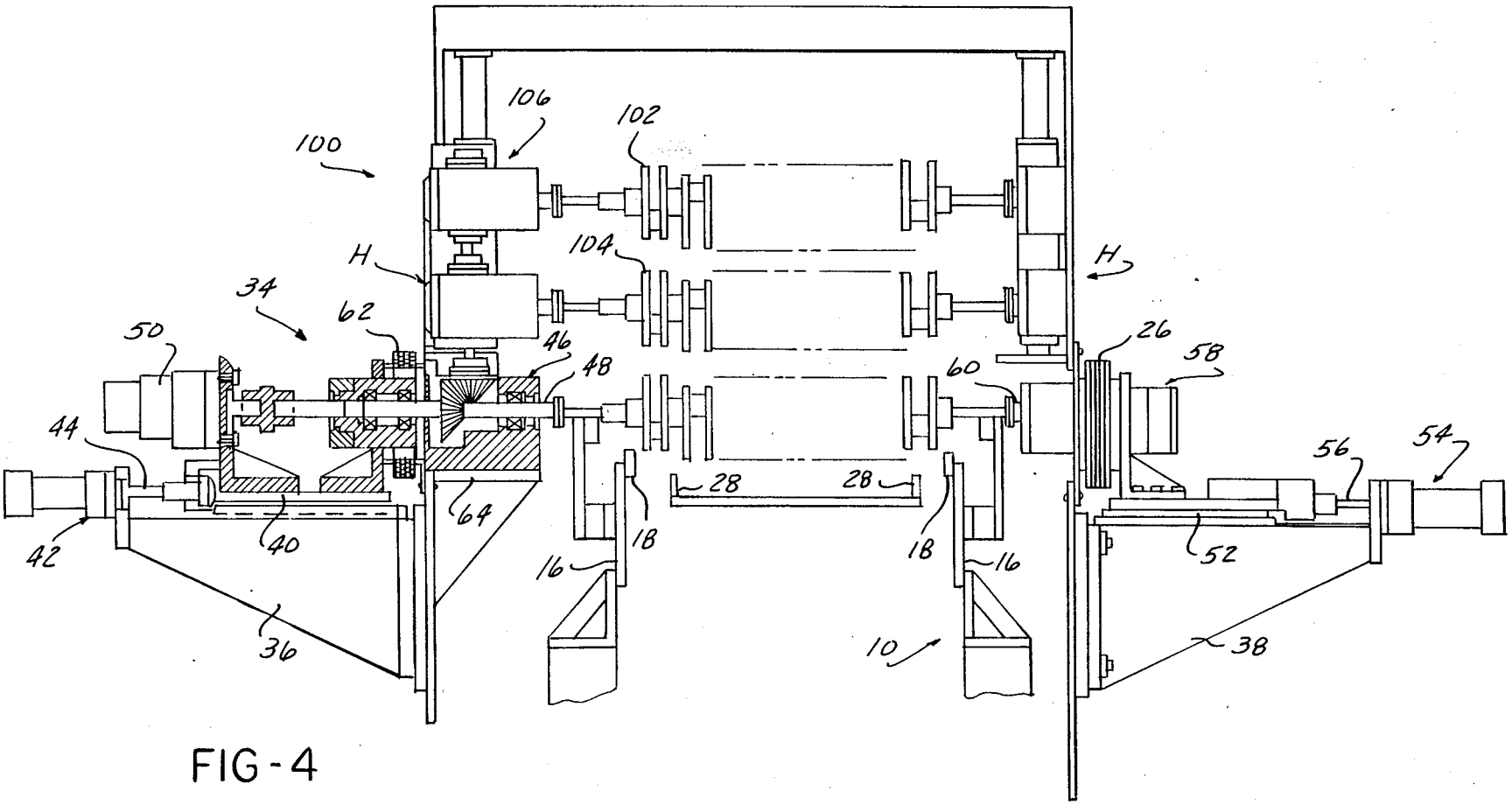
FIG. 4 is a cross-sectional view taken on line 3—3 of FIG. 1, showing another embodiment of the invention with certain parts omitted, added, broken away or shown in section.
Figure 5:
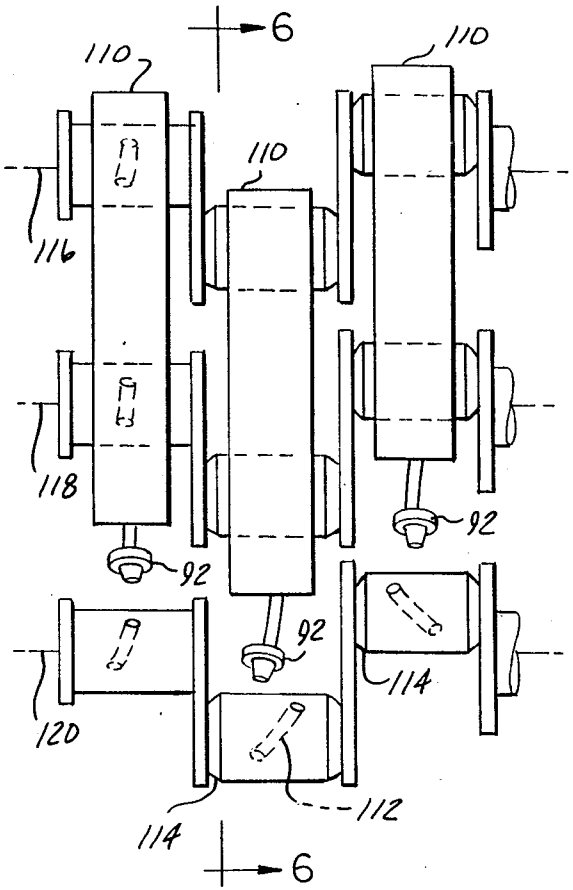
FIG. 5 is a detailed view of the nozzle pantograph means depicted in FIG. 4.

Another embodiment of the invention is shown in FIG. 4. This embodiment of the invention is particularly adapted for cleaning/deburring crankshafts, or other similar parts having an established axis of rotation with radially offset machined surfaces, such as the pin journals and oil holes on crankshafts. The upper portion of FIG. 4 depicts pantograph means 100. The pantograph means 100 supports nozzles 92 of FIG. 5 in close proximity with each journal surface of the crankshaft and maintains the nozzle in close proximity to the journal surface during rotation of the part P to be deburred. Pantograph means 100 can include first and second master shafts 102 and 104. The master shafts 102 and 104 are driven in synchronized rotation with the part P to be cleaned by gear means 106. Orientating means are provided for placing the master shafts 102 and 104 and the part P in synchronized orientation prior to cleaning-/deburring the part P. The orientating means can take the form of part orientating cradle blocks 28 disposed on lift platform 20 to present the part P in a known orientation at the cleaning/deburring station 12. Spring loaded coupling means can be provided to search for the proper orientation of the part P prior to high speed rotation during the cleaning/deburring process.

The coupling member or nozzle connecting block 110 is best seen in FIGS. 5 and 6A through 6C. Although not shown in the drawing, coupling member 110 is normally formed in two or more parts to facilitate mounting of the coupling member 110 onto the master shafts 102 and 104. The parts of the coupling member 110 are then bolted together with the coupling 110 encompassing the aligned journals of the first and second master shafts 102 and 104. A nozzle 92 is dedicated to each main journal surface and each pin journal surface of the crankshaft. With high pressure fluid, preferably in the range of 5,000 to 12,000 psi, the pantograph means can remove burrs from exterior and interior oil passageways 112 and from the 360° circumference of the journal faces, including the undercut area 114. At the cleaning/deburring station, the main journals define the rotational axis 116 and 118 for the master crankshafts 102 and 104, respectively. The main journal of the crankshaft part P also defines the rotational axis 120 for the part to be cleaned and deburred. The main journal nozzles are held constant and the pin journal nozzles orbit or trace the part P 360° about its rotational axis 120. The unit is driven by the master shaft which has the same configuration as the production part to be cleaned and deburred. This provides a very precise nozzle distance from the part's surface and consistent deburring of the part about its entire surface.

Figure 6C:
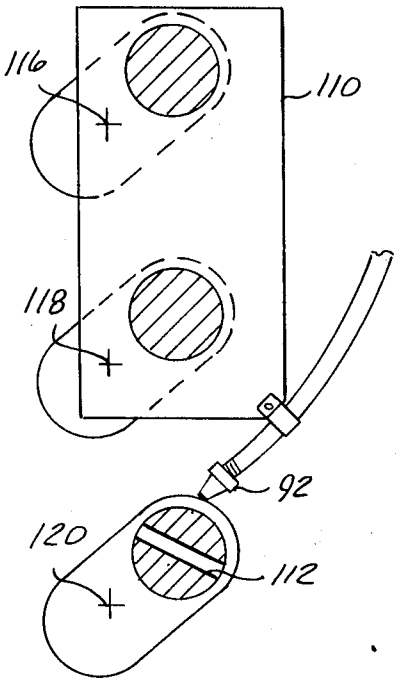
FIGS. 6A–C are detailed views taken on line 6—6 of FIG. 5 showing the nozzle pantograph means in various rotational orientations.
Figure 6B:
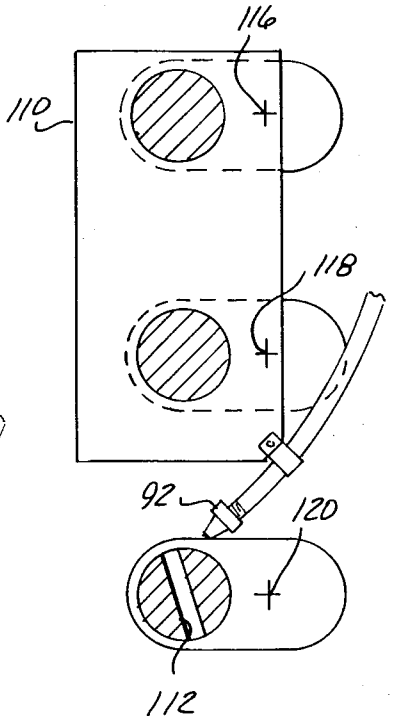
Figure 6A:
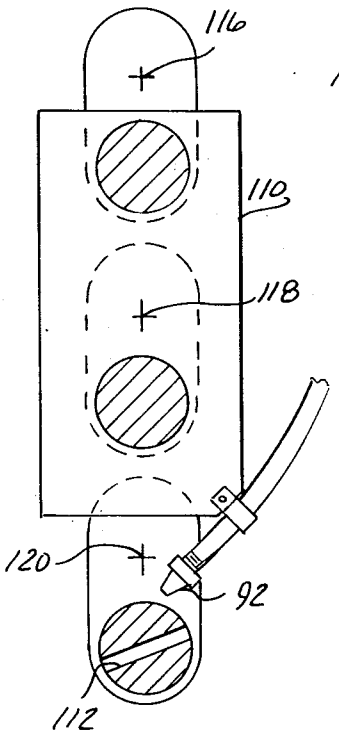

As best seen in FIGS. 6A through 6C, the coupling member 110 supports the nozzle 92 at a predetermined distance in close proximity to the pin journal to be cleaned and deburred. As the shafts are driven in synchronized rotation, the pin journal nozzles 92 orbit or trace the part surface while maintaining the desired predetermined distance from the part surface. This embodiment of the invention can be retooled to accommodate different configurations of parts by removing the master shafts 102 and 104 and replacing them with master shafts of the configuration to be cleaned and deburred, and fitting the couplings 110 to the appropriate main journals and pin journals. It has been demonstrated that at 70% efficiency 150 crankshafts per hour can be processed with this equipment, while using pressurized fluid in the range of 5,000 to 12,000 psi and rotating the parts in the range of 100 to 500 rpm.

The rotation of the part provides precision fluid impact deburring in a small area and reduces pump flow rates, electrical consumption, chemical usage, environmental impact, and plant floor size requirements. The deburring media is filtered city water with mild rust inhibition to prevent flash rust. The flow rates are reduced by the use of the pantograph means which follow each pin journal as it orbits the main journal. As the crankshaft rotates in the spin deburr station, each coupling member or nozzle connecting block 110, pantographs the corresponding pin journal. The pantograph means has a ratio to pin journal tracing of 1 to 1 for every revolution of the crankshaft, and all journal faces are covered 100° with nozzles positioned to maximize impingement and coverage. The pantograph means is synchronized to the rotation of the part by the part rotating device 34.

At drying station 14, an elongate manifold 74 is located and oriented to discharge a relatively thin stream of high velocity air, preferably in the range of 100 to 200 mph, against a part supported in the part rotating device 34 located at drying station 14. The part is rotated at high speed preferably in the range of 500 to 1,000 rpm to centrifugally spin off fluid from the part. Manifold 74 will be configured in accordance with the configuration of the particular parts P being handled, but in general will take the form of an elongated tubular housing having a slot-like axially extending discharge opening 76 oriented to discharge air in a sheet-like flow path which is tangential to the part P held in part rotating device 34. Manifold 76 is supplied with pressurized air from a valve controlled pressurized source of air schematically illustrated at **68*a*. The direction of rotation of part rotating device 34 at drying station 14** is chosen such that the portion of the part against which the airstream is discharged is driven in high speed rotation in a direction opposite to the direction of air flow so that the high velocity air flow tends to strip the fluid from the rotating part surface, through impingement air force not heat of evaporation. The combination of centrifugal and inertial forces exerted on the part as it rotates, spins off fluid, while the air pressure and impingement forces remove any remaining fluid. External heat requirements are eliminated for the drying station by a turbo fan which is used to compress air. The compression of the air automatically increases the discharge temperature 10°–40° F. over ambient. The turbo fan preferably supplies approximately 1400–2400 cfm of air at 34 inches of static pressure, although it should be recognized that this can be varied depending on the production requirements for each particular application of the process.

While the embodiment described above speaks in terms of a walking beam or lift and carry type conveyor, it is believed apparent that the basic task of the conveyor is to simply convey parts in succession into position between the spindles of the part rotating device and to permit the part to be rotated at this fixed location during the cleaning/deburring and drying operations. Thus, other types of conveyors, such as accumulating conveyors might well be employed. While the apparatus has been shown with separate cleaning/deburring and drying stations, in some applications the cleaning-/deburring and drying operations might be performed sequentially at a single station.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. An apparatus for production line deburring of like parts, each part having an established axis of rotation and opposite ends said apparatus comprising:

conveying means for advancing the parts in succession in intermittent step-by-step movement along a fixed path;

part rotating means mounted at a first location on said path for supportingly engaging the opposite ends of a part on said conveying means and for driving the engaged part in high speed rotation about said established axis of rotation; and deburring means adjacent said first location for spraying a high pressure fluid against said part while said part is driven in high speed rotation by said part rotating means to remove microburrs and flashings from said part by a combination of centrifugal forces produced by the high speed rotation and impingement forces produced by the high pressure fluid.

2. The apparatus of claim 1, wherein said deburring means further comprises:

spray nozzle means and a transversing means for reciprocally driving said spray nozzle means along a path parallel to said established axis of rotation of said part, while said part is driven in high speed rotation by said part rotating means.

3. The apparatus of claim 2, further comprising:

nozzle rotating means for rotating said spray nozzle means about an axis as said spray nozzle means is driven reciprocally along said path parallel to said rotational axis of said part.

4. The apparatus of claim 2, wherein the transversing means comprises:

a worm gear extending parallel to said established axis of rotation of said part adjacent said first location;

reversible motor means for rotatably driving said worm gear;

a housing engaging the worm gear for reciprocal movement along the worm gear parallel to the established axis of rotation of the part;

guide means engaging said housing for restricting rotational movement of said housing while allowing reciprocal movement of said housing along said worm gear;

and wherein said spray nozzle means is supported from said housing adjacent said part for spraying high pressure fluid against said part while said part is driven in high speed rotation at said first location.

5. The apparatus of claim 1, wherein said deburring means further comprises:

spray nozzle means and a pantograph means for carrying said spray nozzle means along a path tracing a surface of said part while said part is driven in high speed rotation.

6. The apparatus of claim 5, wherein said pantograph means comprises:

a master part spaced from the engaged part at said first location;

means for driving the master part and the engaged part in synchronized rotation;

nozzle connecting blocks connected to the master part and extending toward the engaged part, such that the nozzle connecting blocks are carried by the master part at a fixed distance from the engaged part as said parts are driven in synchronized high speed rotation; and at least one spray nozzle supported by each nozzle connecting block adjacent said engaged part.

7. The apparatus of claim 6 further comprising part orientating means for presenting the part at a predetermined orientation at said first location.

8. The apparatus of claim 7 further comprising pantograph orientating means for moving the master part into a predetermined initial start position prior to engaging said part at said first location.

9. The apparatus of claim 1 further comprising drying means operable subsequent to said deburring means for directing a high velocity airstream against said rotating part at said first location to strip residual fluid from said part.

10. The apparatus of claim 1 wherein said part rotating means comprises:

a pair of opposed spindles respectively mounted at opposite sides of said fixed path for rotation about a common horizontal axis normal to said fixed path;

positioning means operable to simultaneously move said spindles axially with respect to each other between a normally maintained retracted position wherein said spindles are spaced from each other at a distance greater than a length of a part along its axis and an extended position wherein said spindles are operable to supportingly engage the opposite ends of a part with an axis of the part coaxial with said common axis;

said conveying means being operable during each step of movement of said parts along said fixed path to locate a part at a ready position between said spindles with the part axis coaxial with said common axis;

means operable upon the locating of a part at said ready position for operating said positioning means to move said spindles to said extended position; and means operable when said spindles are in said extended position for driving one of said spindles in high speed rotation.

11. The apparatus of claim 1 wherein said deburring means comprises:

a source of fluid under high pressure;

nozzle means operable when connected to said source for spraying jets of fluid against predetermined portions of the part engaged by said part rotating means; and a normally closed valve control means operable to connect said nozzle means to said source.

12. The apparatus of claim 1 further comprising:

second part rotating means mounted at a second location on said path downstream from said first location for supportingly engaging opposite ends of a part on said conveying means and for driving the engaged part in high speed rotation about said axis of rotation; and drying means adjacent said second location for directing a high velocity airstream against said part to strip off residual fluid from said part, wherein said airstream is directed along a path tangential to the rotating part such that a portion of said part within said airstream moves in a direction opposite to said airstream.

13. The apparatus of claim 12, wherein said second part rotating means comprises:

a pair of opposed spindles respectively mounted at opposite sides of said fixed path for rotation about a common horizontal axis normal to said fixed path;

positioning means operable to simultaneously move said spindles axially with respect to each other between a normally maintained retracted position wherein said spindles are spaced from each other by a distance greater than a length of a part along its axis and an extended position wherein said spindles are operable to supportingly engage the opposite ends of a part with the axis of the part coaxial with said common axis;

said conveying means being operable during each step of movement of said parts along said fixed path to locate a part at a ready position between said spindles with the part axis coaxial with said common axis;

means operable upon the locating of a part at said ready position for operating said positioning means to move said spindles to said extended position; and means operable when said spindles are in said extended position for driving one of said spindles in high speed rotation.

14. The apparatus of claim 12 wherein said drying means comprises:

a source of air under pressure;

nozzle means operable when connected to said source for discharging a high velocity sheet-like stream of air against said part engaged by said second part rotating means; and a normally closed valve control means operable to connect said nozzle means to said source.

15. An apparatus for production line deburring of like parts, each part having an established axis of rotation, said apparatus comprising:

a pair of spaced, parallel side frame members;

a plurality of spaced first cradle blocks aligned and fixedly supported on opposite sides of the parallel frame members to support a shaft-like part with an established axis of rotation extending transversely therebetween in a direction perpendicular to a path of movement of said parts;

a lift platform extending between the parallel side frame members;

means supporting said lift platform for vertical reciprocation between an upper position and a lower position;

a carrier frame slidably mounted on the lift platform for reciprocation along said path of movement between the parallel side frame members;

a plurality of spaced second cradle blocks aligned and fixedly supported on opposite sides of the carrier frame to support said shaft-like part with said axis extending therebetween perpendicular to said path of movement;

means for reciprocating the carrier frame between an upstream position and a downstream position along said path of movement, wherein the lift platform and carrier frame operate cyclically such that the lift platform reciprocating means raises the lift platform from the lower position to the upper position to transfer the shaft-like parts from the first cradle blocks to the second cradle blocks, the carrier frame reciprocating means operates to carry the shaft-like parts downstream along the path of movement, the lift platform reciprocating means lowers the lift platform from the upper position to the lower position transferring the shaft-like parts from the second cradle blocks to the first cradle blocks and the carrier frame reciprocating means returns the carrier platform from the downstream position to the upstream position;

first and second stationary platforms fixedly mounted in transverse alignment with each other at opposite sides of said parallel side frame members and elevated above the side frame members along the path of movement for said parts;

first and second carrier plates slidably mounted on the first and second stationary platforms respectively for movement toward and away from said parts;

first and second spindles rotatively supported by said first and second carrier plates respectively for rotation about a coaxial axis normal to the path of movement of the parts;

means for reciprocating the first and second carrier plates from a retracted position wherein said first and second spindles are axially spaced from each other by a distance greater than an axial length of said parts to an extended position wherein said first and second spindles are coaxially engaging opposite ends of a part supported clear of the first cradle blocks at the downstream position;

high speed rotary means connected to one of the spindles for centrifugally spinning off fluid from said parts by driving the spindle in high speed rotation in a unitary direction about said coaxial axis when said first and second spindles are in the extended position coaxially aligned with the established axis of rotation for the part while the other of the spindles rotates freely;

worm gear means spaced from and extending parallel to said co-axial axis normal to the path of movement of the parts;

reversible motor means for rotatably driving said worm gear means;

a housing engaging the worm gear means for reciprocal movement along a path parallel to said coaxial axis and normal to the path of movement of the parts;

guide means engaging said housing for restricting rotational movement of said housing while allowing reciprocal movement of said housing along said worm gear means;

a source of fluid under high pressure;

nozzle means supported from said housing adjacent said part when said part is engaged between said first and second spindles in the extended position, said nozzle means operable when connected to said source of fluid under high pressure for spraying high pressure jets of fluid against predetermined portions of said part while said part is being driven in high speed rotation by said spindle and while said housing supporting said nozzle means is reciprocated along a path of movement parallel to the established axis of rotation of said part to remove microburrs and flashings from said engaged part by centrifugal forces produced by the high speed rotation and impingement forces produced by the high pressure fluid;

normally closed valve controlled means operable to connect said nozzle means to said source of fluid under high pressure;

a source of air under pressure;

air nozzle means operable when connected to said source of air under pressure for centrifugally stripping fluid from said part by discharging a sheet-like high velocity flow of air tangential to said part in a direction opposite to the rotating part surface; and normally closed valve controlled means operable to connect said air nozzle means to said source of air under pressure after deactivation of said fluid valve controlled means.

16. An apparatus for production line spraying of like parts, each part having an established axis of rotation, said apparatus comprising:

a pair of spaced, parallel side frame members;

a plurality of spaced first cradle blocks aligned and fixedly supported on opposite sides of the parallel frame members to support a shaft-like part with an established axis of rotation extending transversely therebetween in a direction perpendicular to a path of movement of said part;

a lift platform extending between the parallel side frame members;

means supporting said lift platform for vertical reciprocation between an upper position and a lower position;

a carrier frame slidably mounted on the lift platform for reciprocation along said path of movement between the parallel side frame members;

a plurality of spaced second cradle blocks aligned and fixedly supported on opposite sides of the carrier frame to support said shaft-like part with said axis extending therebetween perpendicular to said path of movement;

means for reciprocating the carrier frame between an upstream position and a downstream position along said path of movement, wherein the lift platform and carrier frame operate cyclically such that the lift platform reciprocating means raises the lift platform from the lower position to the upper position to transfer the shaft-like parts from the first cradle blocks to the second cradle blocks, the carrier frame reciprocating means operates to carry the shaft-like parts downstream along the path of movement, the lift platform reciprocating means lowers the lift platform from the upper position to the lower position transferring the shaft-like parts from the second cradle blocks to the first cradle blocks and the carrier frame reciprocating means returns the carrier platform from the downstream position to the upstream position;

first and second stationary platforms fixedly mounted in transverse alignment with each other at opposite sides of said parallel side frame members and elevated above the side frame members along the path of movement for said parts;

first and second carrier plates slidably mounted on the first and second stationary platforms respectively for movement toward and away from said parts;

first and second spindles rotatably supported by said first and second carrier plates respectively for rotation about a coaxial axis normal to the path of movement of the parts;

means for reciprocating the first and second carrier plates from a retracted position wherein said first and second spindles are axially spaced from each other by a distance greater than an axial length of said parts to an extended position wherein said first and second spindles are coaxially engaging opposite ends of a part supported clear of the first cradle blocks at the downstream position;

high speed rotary means connected to one of the spindles for centrifugally spinning off fluid from said parts by driving the spindle in high speed rotation in a unitary direction about said coaxial axis when said first and second spindles are in the extended position coaxially aligned with the established axis of rotation for the part while the other of said spindles rotates freely;

a master part spaced from and parallel to said coaxial axis normal to the path of movement of the parts;

means for driving the master part and a part engaged between said first and second spindles in synchronized rotation;

nozzle connecting blocks connected to the master part and extending toward the engaged part, such that the nozzle connecting blocks are carried by the master part at a fixed distance from the engaged part as said parts are driven in synchronized high speed rotation;

a source of fluid under high pressure;

nozzle means supported by each nozzle connecting block adjacent said engaged part operable when connected to said source of fluid under high pressure for discharging high pressure jets of fluid against predetermined portions of said part while said part is being driven in high speed rotation by said spindle to remove microburrs and flashings from said engaged part by centrifugal forces produced by the high speed rotation and impingement forces produced by the high pressure fluid;

normally closed valve control means operable to connect said nozzle means to said source of fluid under high pressure;

a source of air under pressure;

air nozzle means operable when connected to said source of air under pressure for centrifugally stripping fluid from said part by discharging a sheet-like high velocity flow of air tangential to said part in a direction opposite to the rotating part surface; and normally closed valve control means operable to connect said air nozzle means to said source of air under pressure after deactivation of said fluid valve control means.

* * * * *